United States Patent [19]

Berry

[11] 4,177,304

[45] Dec. 4, 1979

[54] METHOD OF COATING BOTH SIDES OF A TRAVELLING WEB

[75] Inventor: Kenneth W. Berry, Beloit, Wis.

[73] Assignee: Beloit Corporation, Beloit, Wis.

[21] Appl. No.: 868,396

[22] Filed: Jan. 10, 1978

Related U.S. Application Data

[62] Division of Ser. No. 778,506, Mar. 17, 1977, Pat. No. 4,108,110.

[51] Int. Cl.[2] ..... B05D 1/18

[52] U.S. Cl. ..... 427/434 R; 427/209; 427/211; 427/428; 427/434 B

[58] Field of Search ..... 118/407, 405, 414, 412, 118/249, 262, 206, 304; 427/428, 209, 211, 434 R, 434 B

[56] References Cited

U.S. PATENT DOCUMENTS

| | | | |
|---|---|---|---|
| 2,321,938 | 6/1943 | Quinn | 118/206 X |
| 2,870,738 | 1/1959 | Jacobs et al. | 118/249 |
| 3,097,968 | 7/1963 | Schaefer | 118/262 X |
| 3,120,449 | 2/1964 | Griswold | 427/211 X |
| 3,132,040 | 5/1964 | Charles-Messance | 427/211 |
| 3,146,159 | 8/1964 | Muggleton | 118/262 X |
| 3,676,184 | 7/1972 | Spearin et al. | 427/211 |
| 3,897,576 | 7/1975 | Qualtrough | 427/211 X |
| 3,899,615 | 8/1975 | Wallsten | 427/211 |
| 3,911,174 | 10/1975 | Rose | 427/211 |
| 3,922,391 | 11/1975 | Qualtrough et al. | 427/211 X |

FOREIGN PATENT DOCUMENTS

| | | | |
|---|---|---|---|
| 28136 | 4/1964 | German Democratic Rep. | 118/407 |

*Primary Examiner*—Shrive P. Beck

*Attorney, Agent, or Firm*—Hill, Van Santen, Steadman, Chiara & Simpson

[57] ABSTRACT

Both sides of a travelling web are continuously but separately coated with coating material by passing the web through successive roll-formed puddles in a simple three roll arrangement.

6 Claims, 4 Drawing Figures

W
9
7
8
5
27
10
12
11
34
25
30a
19
30
18
17
31
20
15
III
26
33
33a
28a
28
14
32b
32
32a
21
35
37
23
22
13
24
29
IV

METHOD OF COATING BOTH SIDES OF A TRAVELLING WEB

This is a division of application Ser. No. 778,506, filed Mar. 17, 1977, now U.S. Pat. No. 4,108,110.

This invention relates to the art of coating webs, such as paper webs, and is more particularly concerned with efficiently coating both sides of a travelling web.

Numerous and varied web coating expedients have been proposed heretofore for coating travelling webs requiring differentiation between the coating applied to one side as compared to the coating applied to the opposite side. Sometimes one side of the web is coated and dried or cured and then the other side of the web is coated and dried in two separate operations. Other arrangements include puddle coating one side of the web and transfer roll coating the opposite side of the web. Arrangements are also provided wherein both sides of the web are coated by transfer rolls, that is where the coating material is received on or picked up by the surface of a transfer roll and the face of the web to receive the coating material is run on the transfer roll to receive the coating material. Commonly a plurality or series of different and duplicate sets of rolls or other mechanism are required to apply the different coatings, requiring extended valuable floor space, extending the apparatus costs for this purpose and requiring excessive operating attention and maintenance.

An important object of the present invention is to provide a new and improved method of for coating both sides of a travelling web and which will overcome the disadvantages, deficiencies, inefficiencies, shortcomings and problems inherent in prior methods and apparatus.

Another object of the invention is to provide a new and improved method of continuously efficiently applying coating to both sides of a travelling web from puddles in a simple three roll apparatus.

A further object of the invention is to provide a new and improved puddle coating method for continuously travelling webs.

According to features of the invention a new and improved method of puddle coating both sides of a travelling web, comprises running one side of the travelling web in engagement with a substantial segment of the perimeter of a roll rotating in the same direction as the travel of the web, forming a first puddle of coating material between the roll and the web where the web approaches and enters into engagement with said segment of the perimeter of the roll and thereby coating said one side of the web, protecting the opposite side of the web from the coating material in said first puddle, forming a second puddle of coating material on said opposite side of that portion of the web running in engagement with said segment of the roll perimeter, and maintaining said first surface of the web in firm engagement with said segment of the perimeter of the roll at said second puddle and thereby protecting said first side of the web from the coating material in said second puddle. In a preferred embodiment the method is practiced in a simple three roll coater assembly.

Other objects, features and advantages of the invention will be readily apparent from the following description of certain representative embodiment thereof, taken in conjunction with the accompanying drawing although variations and modifications may be effected without departing from the spirit and scope of the novel concepts embodied in the disclosure and in which.

Figures 1, 2, 3, 4:
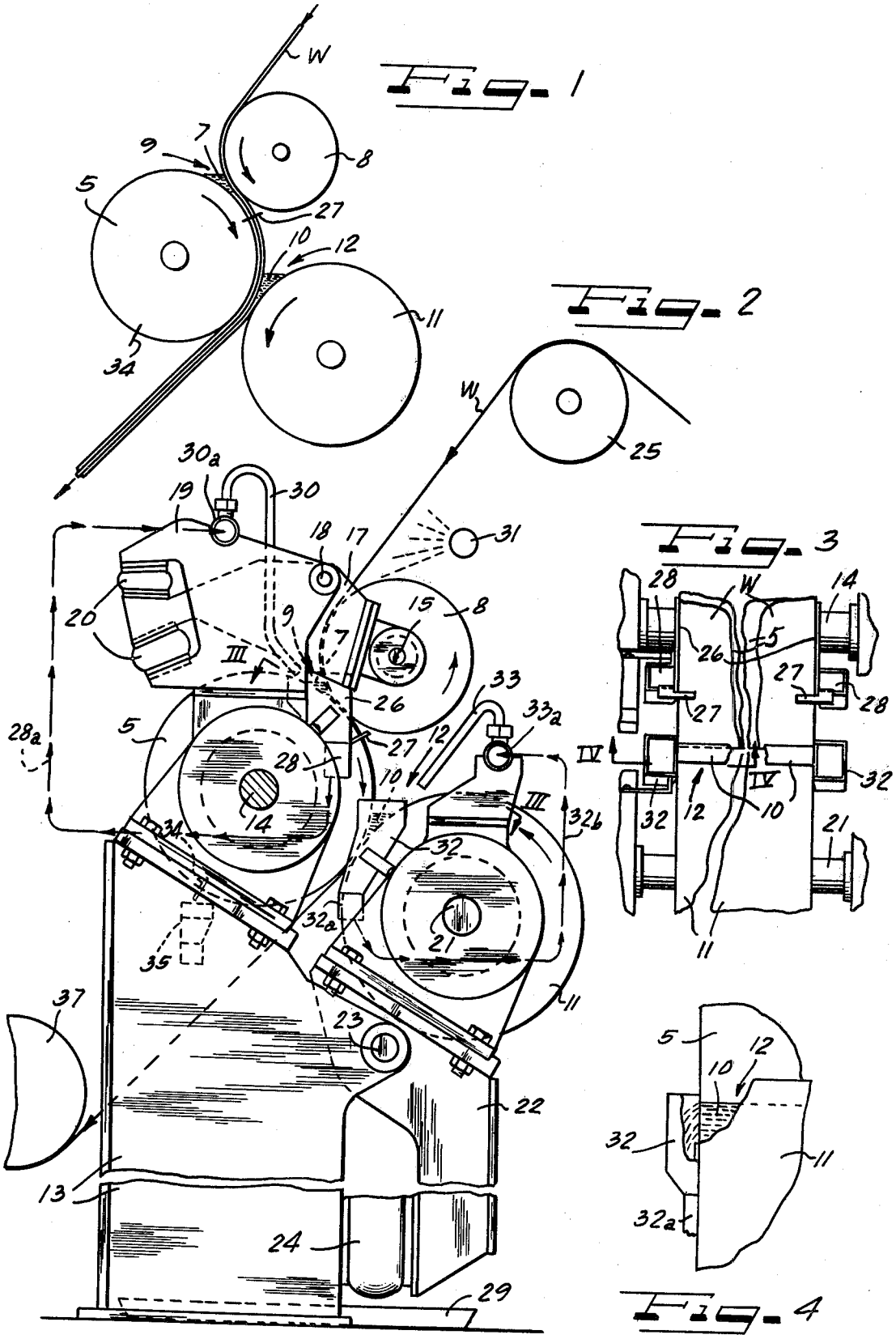
FIG. 1 is a schematic illustration demonstrating method and apparatus for practicing the present invention
FIG. 2 is a side elevational view, partially in section, and partially schematic, of apparatus embodying the device schematically illustrated in FIG. 1.
FIG. 3 is a fragmental elevational view taken substantially along the line III—III of FIG. 2.
FIG. 4 is a fragmentary sectional elevational view taken substantially along the line IV—IV of FIG. 3.

On reference to FIG. 1, a method of puddle coating both sides of a travelling web W is demonstrated, according to which one side of the travelling web W is run in engagement with a substantial segment of the perimeter of a horizontal roll 5 of substantial diameter and rotating, as shown by directional arrows, in the same direction as the web travels. A first puddle 7 of coating material is formed between the roll 5 and the web W where the web approaches and enters into engagement with the segment of the perimeter of the roll, thereby coating the roll-engaging side of the web. The opposite side of the web is protected from the coating material in the puddle 7 by means comprising a second, horizontal roll 8 rotating freely with the opposite side of the web W in firm engagement with a substantial segment of the perimeter of the roll 8 as the web approaches the puddle 7 and until the web passes through the nip of the rolls 5 and 8, defining, in effect, a generally upwardly directed trough 9 for the puddle 7. From the nip between the rolls 5 and 8, the web travels on the roll 5 with the coated face in firm engagement with the perimeter of the roll 5 until the web travels through a second puddle 10 of coating material generally below the nip of the rolls 5 and 8 and formed above the nip of the roll 5 and a third roll 11 defining a generally upwardly directed puddle trough 12 wherein the side of the web opposite to that which was coated in the puddle 7 is coated with the material in the puddle 10 while the first coated side of the web is in firm running engagement with the roll 5 and thus protected from the coating material in the puddle 10. After the web W travels past the nip of the rolls 5 and 11, it diverges from the roll 5 and the coated web moves onto a point of use or to a roll up reel. If necessary, suitable drying means may be associated with the coated web. The coating materials in the puddles 7 and 10 may be of any preferred form that can be handled this way, such as sometimes referred to in the papermaking industry as "color." These materials may comprise very light, thin materials such as sizing or fire resistant fluid which may comprise as little as $1\frac{1}{2}$ pounds per 3000 $ft^2$ of web area, to clay based coating for paper which may weigh as much as 10 pounds per 3000 $ft^2$ of web area.

For a more detailed understanding of the simple three roll puddle coating apparatus, attention is directed to FIG. 2, wherein it will be observed that the roll 5 is mounted rotatably on a fixed axis on top of a suitable frame 13 and is corotatably fixed on an axle 14 which is adapted to be driven to rotate the roll by any suitable means such as a motor drive (not shown). The roller 8 is rotatably mounted by means of an axle 15 on a rocker carriage 17 which is pivotally mounted by means of suitable trunnion structure 18 on an upward extension 19 from that portion of the frame 13 on which the roll 5 is mounted. The arm 17 extends in one direction from the pivot 18 to support the roll 8 for movement toward or away from the roll 5 and the arm projects in the opposite direction from the pivot 18 to and between inflatable air springs 20 which are suitably controlled to either thrust the roll 8 into nip engagement with an upper portion of the off running side of the roll 5 at the top of a substantial segment of the perimeter area of the roll 5 over which the web W runs in operation. The air springs 20 are also arranged to be operated to actuate the arm 17 to lift the roll 8 away from the roll 5 when desired.

Mounting of the roll 11 for nip engagement with the roll 5 at a suitable distance below the roll 8 and while the web W is still in firm running engagement with the desired substantial segment of the periphery of the roll 5 is effected by means of an axle or pintles 21 on a carriage 22 which is rockably mounted as by means of an axle or pintles 23 on the frame 13 so that the carriage 22 can be actuated by means of an air spring 24 to urge the roll 11 into nip engagement with the roll 5. When desired, the air spring 24 can be operated to permit the roll 11 to swing away from the nip with the roll 5.

The web W is guided by means of a guide roll 25 to approach the roll 8 tangentially substantially above the puddle 7 so that the web is in firm engagement with the roll 8 at the puddle 7. In operation the nip of the rolls 5 and 8 is of sufficient firmness to assure a tight bottom closure for the puddle trough 9 and to squeeze the web W against the roll 5 with sufficient pressure to effect driving of the web at the speed of the roll 5 without any appreciable slippage. To implement its functions, the roll 8 may have a resilient, rubber surface.

At each end of the puddle trough 9 suitable edge pan means 26 are carried by the frame 13 adjacent the ends of the rolls 5 and 8 whereby to receive coating material flowing from the puddle 7 during operation. Inasmuch as some of the coating material may be carried beyond the puddle 7 on the ends of the main roll 5, means acting on the main roll ends and cooperating with the side edges of the web W, and desirably in the form of scrapers 27 (FIGS. 2 and 3) which may be formed from synthetic plastic material such as nylon, are carried by the edge pans 26 to scrape from the roll ends and possibly also from the web side edges avoid carrying onward of the coating material from the puddle 7, and direct the scraped material into the edge pans 26. Thereby the opposite side of the web from that coated by the puddle 7 is protected against migration of the coating material from the opposite ends of the main roll 5 onto such opposite side of the web. Suitable outlets 28 from the edge pans 26 may deposit in waste disposal such as a pan 29 at the base of the frame 13 but preferably recycle the material for return to the puddle 7. Coating material is supplied to the puddle 7 from suitable supply means including a duct and delivery nozzle 30 directed toward the trough 9, and which leads from a header 30*a* conveniently carried by the frame extension 19. Suitable return duct means 28*a* lead from the outlets 28 to the header 30*a*. It will be understood that suitable control means maintain the coating material supply delivered to the puddle 7 at substantially optimum level consistent with the speed of travel of the web W and pickup of the coating material by the web. If desired, means comprising a shower head 31 may be mounted adjacently over the roll 8 to shower the web W for improved coating material penetration and to wet the edges of the web for controlling edge curl.

In the substantial segmental area of the perimeter of the roll 5 between the nips at the rolls 8 and 11, the web W is maintained in firm running engagement with the perimeter of the roll 5 so that as the web passes through the second coating puddle 10, the side of the web previously coated in the puddle 7 will be protected from the material in the puddle 10 while the side of the web opposite to that which has already been coated is coated with the material in the puddle 10. Any spillover of coating material from the ends of the puddle 10 is received in receptacle means comprising edge pans 32 (FIGS. 3 and 4) which may drain off through discharges 32*a* to the tray 29 but preferably recycle the material. Means for supplying the puddle 10 with coating material under suitable control comprise a duct nozzle 33 directed toward the trough 12 and leading from a header 33*a* suitably mounted on the carriage 22 above the roll 11. Suitable return duct means 32*b* lead from the outlets 32*a* to the header 33*a*.

Any residual coating material from the puddle 10 which may cling to the ends of the roll 5 is removed by means of scrapers 34 at each end of the roll, similar to the scrapers 27, and located at the bottom of the up running side of the roll so that there will be no tendency of the residual coating material to mix with and contaminate the coating material in the puddle 7. Coating material removed by the scrapers 34 is received in a trough 35 which drains into the pan 29.

Beyond the nip of the rolls 5 and 11, the coated web leaves the coating rolls and may enter a dryer which may comprise one or more dryer rolls 37 (FIG. 2).

At the beginning of a coating operation, the web W is threaded through the coating roll stack, the rolls 8 and 11 firmed up against the roll 5, and the puddle troughs 9 and 12 supplied with the puddles 7 and 10 of coating material. At conclusion of the coating operation, in preparation for clean-up of the apparatus, coating supply to the puddles is discontinued, and the puddles permitted to drain into the end pans. The upper roll 8 may then be lifted away from the roll 5 and the roll 11 may be moved away from the roll 5. Should there be a malfunction such as a break in the web which may lead to contamination of material in the puddles, it may be expedient to separate the rolls and dump the coating material into the pan 29. From the foregoing it will be apparent that the present invention offers numerous improvements and advantages over prior devices and methods. A simple three roll coater apparatus continuously applies two separate coatings to the web and can be accommodated in a limited floor area in a papermaking machine lineup. with a single dryer section to dry both sides of the web at the same time, thus minimizing the length of the papermaking machine. In fact, the two puddle coater of the present invention will occupy no more space than a conventional sizing press wherein both sides of the web run through the same sizing bath or applicator. Although two different color, i.e., coating material, puddles are operatively located in close association at the same side of the principal, driven roll of the applicator assembly, the color material in the two puddles is maintained completely separated without contamination of one puddle with material from the other puddle. Should there be a sheet, i.e., web, break, the puddles are so tightly contained that little if any of the coating material will be lost. Where desired, the coater of the present invention can be easily mounted as an addition to an existing size press. A single dryer section serves to dry both sides of the web concurrently, instead of requiring separate dryer sections for each side as has been general prior practice where each side of the web is coated as a separate successive operation.

It will be understood that variations and modifications may be effected without departing from the spirit and scope of the novel concepts of this invention.

I claim as my invention:

1. A method of puddle coating both sides of a travelling web, comprising:

forming a first puddle of coating material in generally upwardly directed trough at the upper side of a first nip of a first horizontal roll and a second horizontal roll;

forming a second puddle of coating material below said first nip in a generally upwardly directed trough at the upper side of a second nip formed by said second roll and a third roll;

running one side of a continuously travelling web in firm engagement directly with the perimeter of said first roll through said first puddle and said first nip and thereby coating the opposite side of said web in said first puddle while protecting said one side against the coating material of the first puddle by running of the one face in said engagement with the perimeter of said first roll;

below said first nip running said coated opposite side of the web in direct engagement with the perimeter of said second roll and through said second puddle and said second nip and thereby exposing the uncoated side of the web to the coating material in said second puddle and maintaining the coated side of the web in said running engagement with said third roll and thereby protecting said coated side of the web from the coating material in said second puddle;

and preventing migration of coating material via the opposite ends of said second roll from either of said puddles to the other of said puddles.

2. A method according to claim 1, comprising treating said web in advance of the first puddle to control curl and coating material pentration.

3. A method according to claim 1, comprising draining away spill-over from said second puddle.

4. A method according to claim 1, comprising concurrently drying both sides of the web after it leaves the second puddle.

5. A method according to claim 1, comprising scraping the ends of said second roll to remove coating material thereon which may be derived from either of said puddles.

6. A method according to claim 5, comprising receiving spill-over of coating material from the ends of said first puddle in edge pans associated with the opposite ends of said second roll, and returning to said edge pans material of the first puddle scraped from the ends of said second roll.

* * * * *